US006017160A

United States Patent [19]

Sato et al.

[11] Patent Number: 6,017,160

[45] **Date of Patent: *Jan. 25, 2000**

[54] PRINTER SHEET FEED DEVICE HAVING CONTROLLER

[75] Inventors: Minoru Sato; Tadashi Nakamura, both of Iwate-ken, Japan

[73] Assignee: Alps Electric Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,582

[22] Filed: Dec. 27, 1996

[30] Foreign Application Priority Data

Jan. 8, 1996 [JP] Japan ..... 8-000999

[51] Int. Cl.[7] ..... B41J 11/42; B65H 7/02

[52] U.S. Cl. ..... 400/582; 271/265.01; 271/266; 400/708

[58] Field of Search ..... 400/555, 568, 400/582, 708, 902, 605; 271/258.01, 265.01, 266

[56] References Cited

U.S. PATENT DOCUMENTS

| | | | |
|---|---|---|---|
| 4,778,296 | 10/1988 | Takahashi | 400/902 |
| 4,834,564 | 5/1989 | Oda | 400/568 |
| 4,834,568 | 5/1989 | Kagami et al. | 400/708 |
| 4,875,790 | 10/1989 | Karube et al. | 400/568 |
| 4,934,845 | 6/1990 | Kato | 400/708 |
| 4,976,557 | 12/1990 | Uchikata | 400/568 |
| 5,050,858 | 9/1991 | Nakamura | 400/555 |
| 5,097,273 | 3/1992 | Moro et al. | 400/708 |
| 5,169,249 | 12/1992 | Kitabata | 400/582 |
| 5,520,383 | 5/1996 | Amagai et al. | 400/582 |
| 5,564,848 | 10/1996 | Quintana | 400/708 |
| 5,584,590 | 12/1996 | Ito | 400/605 |
| 5,639,171 | 6/1997 | Brewster | 400/708 |

FOREIGN PATENT DOCUMENTS

| | | | |
|---|---|---|---|
| 8-002054 | 9/1996 | Japan | 400/555 |

*Primary Examiner*—Edgar Burr
*Assistant Examiner*—Leslie J. Grohusky
*Attorney, Agent, or Firm*—Brinks Hofer Gilson & Lione

[57] ABSTRACT

The invention comprises a rotatable sheet feed roller; a rotatable press-contacting roller capable of press-contacting against an outer peripheral surface of the sheet feed roller; a sheet feed motor, being a stepping motor, for rotationally driving the sheet feed roller; and a transmission mechanism for transmitting the rotational power of the sheet feed motor to the sheet feed roller; wherein a line feed starting position of the recording sheet at a initial predetermined pitch is set to permit continuation of line feeding by a predetermined amount from a moment a mechanical condition with respect to the recording sheet changes during line feeding at a portion where the mechanical condition changes. The invention provides a printer that performs line feeding by a very accurate amount by line feeding at a constant pitch, even though a mechanical condition of the sheet feed mechanism changes.

1 Claim, 4 Drawing Sheets

PRINTER SHEET FEED DEVICE HAVING CONTROLLER

BACKGROUND OF THE INVENTION

1. Field of the Invention

The present invention broadly relates to a printer sheet feed device for conveying recording paper sheets, and a sheet feed control method thereof, and, more particularly, to a printer sheet feed device for conveying recording sheets with high precision, and a sheet feed control method thereof.

2. Description of the Related Art

A serial-type printer is often used, which prints one line while a print head moves along a platen, and then conveys the recording sheet by an amount corresponding to one line in order to perform printing on the next line.

FIG. 4 illustrates a thermal transfer printer as an example of a serial-type printer. In the thermal transfer printer, a flat platen 2 is disposed at about the center of a printer frame 1 such that the print face of the platen 2 is disposed substantially vertically. A carriage shaft 3 is disposed at a location of the frame 1 forwardly of and below the platen 2 and parallel to the platen 2. A flange-shaped guide section 4 is formed at the front edge of the frame 1, while a carriage 5 is mounted to the carriage shaft 3 and the guide section 4 such that it can reciprocate along the carriage shaft 3 and the guide section 4. A thermal head 6, functioning as a print head, is mounted to an end of the carriage 5 which opposes the platen 2, and can come into contact with and move away from the platen 2 by means of a drive mechanism (not shown). A ribbon cassette (not shown) is removably mounted to the upper face of the carriage 2 in order to guide an ink ribbon between the thermal head 6 and the platen 2. A take-up bobbin for taking up the ink ribbon and a supply bobbin are disposed at the upper face of the carriage 5, and engage the ribbon cassette take-up reel and the supply reel, respectively.

A sheet insertion opening 9 is formed behind the platen 2 in order to feed the recording sheet (not shown) forwardly of the platen 2. Sheet feed rollers 10 are disposed at the sheet insertion opening 9 in order to convey the recording sheet between the thermal head 6 and the platen 2. Press-contacting rollers 11, rotatably disposed below the sheet feed rollers 10, press-contact their sheet feed rollers 10. Actually, a plurality of the press-contacting rollers 11 are provided at different locations where they press-contact the sheet feed rollers 10 in the direction of the circumference, in which at the start of conveying one recording sheet, only the press-contacting roller at the upstream side in the direction of conveyance of the recording sheet contributes to the conveyance of the recording sheet, while at the end of the conveyance of the recording sheet, only the press-contacting at the downstream side in the direction of the conveyance of the recording sheet contributes to the conveyance of the recording sheet.

A sheet feed gear 12, mounted coaxially with the sheet feed roller 10, projects out from a side face of the frame 1. A motor gear 15 driven by a sheet feed motor 14 which is a stepping motor is connected to the sheet feed gear 12 via a plurality of transmission gears 13. Driving the sheet feed motor 14 rotationally drives the sheet feed roller 10 via the motor gear 15, the transmission gears 13, and the sheet feed gear 12, whereby a recording sheet, nipped between the sheet feed rollers 10 and the press-contacting rollers 11, is conveyed.

FIG. 5 is a view showing the critical portion of a printer sheet feed device, wherein the sheet feed gear 12 is mounted to one end of a rotating shaft 16 and coaxially with the sheet feed roller 10. The sheet feed roller 10 is mounted to the rotating shaft 16, and is disposed such that the outer peripheral surface of the rotatable press-contacting roller can press contact it. The sheet feed motor 14, being a stepping motor, is disposed in the vicinity of the sheet feed gear 12 in order to rotationally drive the sheet feed roller 10. A motor gear 15 is affixed to an output shaft 17 of the sheet feed motor 14, with the motor gear 15 and the sheet feed gear 12 connected via a first transmission gear 13*a*, a second transmission gear 13*b*, and a third transmission gear 13*c*, which are formed at the outer peripheral portion. The first transmission gear 13*a* comprises a large gear section 18*a* and a small gear section 19*a* formed coaxially therewith. The second transmission gear 13*b* comprises a large gear section 18*b* and a small gear section 19*b* formed coaxially therewith. The third transmission gear 13*c* comprises a large gear section 18*c* and a small gear section 19*c* formed coaxially therewith. The motor gear 15 engages with the large gear section 18*a* of the first transmission gear 13*a*, the small gear section 19*a* of the first transmission gear 13*a* engages with the large gear section 18*b* of the second transmission gear 13*b*, the small gear section 19*b* of the second transmission gear 13*b* engages with the large gear section 18*c* of the third transmission gear 13*c*, and the small gear section 19*c* of the third transmission gear 13*c* engages with the sheet feed gear 12. The rotation of the sheet feed motor 14 is slowed down by these gear groups in order to transmit the rotation to the sheet feed gear 12.

When the sheet feed roller 10 is rotationally driven by an amount corresponding to one line feed pitch, the gear ratio of the motor gear 15 and the transmission gears 13*a*, 13*b*, and 13*c* is set such that the motor gear 15 and the transmission gears 13*a*, 13*b*, and 13*c* always stop at the rotation start position. For example, the gear ratio of the motor gear 15, the transmission gears 13*a*, 13*b*, and 13*c*, and the sheet feed gear 12 is set at 3:4:4:5. With the gear ratio set thus, the motor gear 15 and the transmission gears 13*a*, 13*b*, and 13*c* stop at the same position both before the start of line feeding (shown in FIG. 6A) and after the line feeding (shown in FIG. 6B), so that the problem related to the eccentricities of each of the gears 15, 13*a*, 13*b*, and 13*c* does not occur.

More specifically, when the number of teeth of the motor gear 15 is 14, the number of teeth of the large gear section 18*a* and that of the small gear 19*a* of the first transmission gear 13*a* are 42 and 14, respectively; the number of teeth of the large gear section 18*b* and that of the small gear section 19*b* of the second transmission gear 13*b* are 56 and 14, respectively; and the number of teeth of the large gear section 18*c* and that of the small gear 19*c* of the third transmission gear 13*c* are 56 and 14, respectively; and the number of teeth of the sheet feed gear is 70.

When the desired printing is performed using the serial-type printer, the paper sheet is inserted into the sheet insertion opening and the sheet feed motor 14 is driven to rotate the sheet feed roller 10 via the motor gear 15, the transmission gears 13*a*, 13*b*, and 13*c*, and the sheet feed gear 12, whereby the recording sheet is conveyed such that its printing start position is at the printing position. Thereafter, with the thermal head 6 kept press-contacted with the platen 2, each of the thermal elements of the thermal head 6 are driven on the basis of a desired drive signal, while the carriage 5 is driven, as a result of which the desired printing is performed on the recording sheet.

Upon completion of one line of printing, while the thermal head 6 is kept separated from the platen, the sheet feed motor 14 is driven by a predetermined number of steps to rotate the sheet feed roller 10 by a predetermined angle, whereby the recording sheet is conveyed by one line feed pitch. Here, as described above, the motor gear 15, and the transmission gears 13*a,* 13*b,* and 13*c* rotate an integral number of times and returns to its initial start position, so that the problem related to eccentricities or the like of the gears 15, 13*a,* 13*b,* and 13*c* does not occur, resulting in a very accurate amount of sheet feeding.

In the above-described printer sheet feed device, however, at the moment the back edge of the recording sheet passes between the sheet feed roller and the press-contacting roller 11 disposed upstream in the direction of conveyance of the recording sheet, the recording sheet is bent due to the rigidity of the sheet so that a force which pushes out the recording sheet forwardly acts on the recording sheet (the mechanical condition of the sheet feed mechanism with respect to the recording sheet is changed), causing the recording sheet to be conveyed by an amount greater than the specified line feed pitch (the difference being equal to the amount of backlash between the sheet feed gear 15 and the transmission gear 13*c*), even when the press-contacting roller 11 disposed downstream in the direction of conveyance of the recording sheet is conveying the recording sheet by the correct amount. Therefore, when line feeding is terminated at a location immediately following this location, the excess amount of line feeding being in correspondence with the amount of backlash is not eliminated, so that a space is produced between lines during printing immediately following the termination of the line feeding, resulting in reduced printing quality.

Excessive line feeding tends to be particularly noticeable when a relatively rigid recording paper sheet, such as a relatively thick postcard, is used.

Other mechanical condition changes, such as displacement of the back edge of the recording paper sheet from the edge of the sheet guide section, occur, may change the line feed pitch.

SUMMARY OF THE INVENTION

Accordingly, an object of the present invention is to provide a printer sheet feed device and a sheet feed control method thereof, wherein in the case where a recording sheet is conveyed at a plurality of locations of the recording sheet, even when a mechanical condition changes during line feeding when the back edge of the recording sheet passes between an upstream roller in the direction of conveyance of the recording sheet, line feeding at a predetermined pitch is performed by means of another roller.

Another object of the present invention is to provide a printer sheet feed device and a sheet feed control method thereof, wherein in the case where a recording sheet is conveyed at either a single location or a plurality of locations of the recording sheet, when other mechanical conditions change, such as when the back edge of the recording sheet is displaced from the edge of the sheet guide section, sheet feeding is performed at a predetermined line feed pitch.

A further object of the present invention is to provide a control means for controlling the setting position of a recording sheet at the printing section when line feeding is started at a predetermined pitch, in accordance with the type of recording sheet.

A still further object of the present invention is to provide a control means for controlling the position of starting line feeding of a recording sheet at a predetermined pitch such that line feeding at a portion where a mechanical condition changes with respect to the recording sheet is performed at a position allowing continuation of line feeding by a predetermined amount from the moment the mechanical condition changes.

A still further object of the present invention is to make it possible to set a starting position of line feeding of the recording sheet by a predetermined pitch, such that line feeding at a portion where a mechanical condition changes with respect to the recording sheet is performed at a location allowing sheet feeding by a predetermined amount from the moment the mechanical condition changes, after which the sheet feed motor is driven under control by a predetermined number of drive steps which corresponds to a predetermined line feed pitch.

A still further object of the present invention is to make it possible to perform line feeding unaffected by changes in the mechanical condition of the sheet feed mechanism with respect to the recording sheet, even when line feeding at a constant pitch is performed, by terminating the line feeding after elimination of the extra line feeding being equivalent to the amount of backlash produced due to changes in the mechanical condition by constant continued line feed operations by more than a predetermined amount from the position the back edge of the recording sheet jumps due to its rigidity, that is from the position the mechanical condition of the sheet feed mechanism changes with respect to the recording sheet.

A still further object of the present invention is to make it possible to constantly perform line feeding by an equal amount by another conveying means, even when a first conveying means does not contribute to the conveyance of a recording sheet at a plurality of locations in the direction of conveyance of the recording sheet; and to make it possible to constantly perform line feeding by an equal amount in the same way, even when the mechanical condition changes, such as when the back edge of the recording sheet is displaced from the sheet guide section or the like.

DESCRIPTION OF THE PREFERRED EMBODIMENTS

Figure 1:
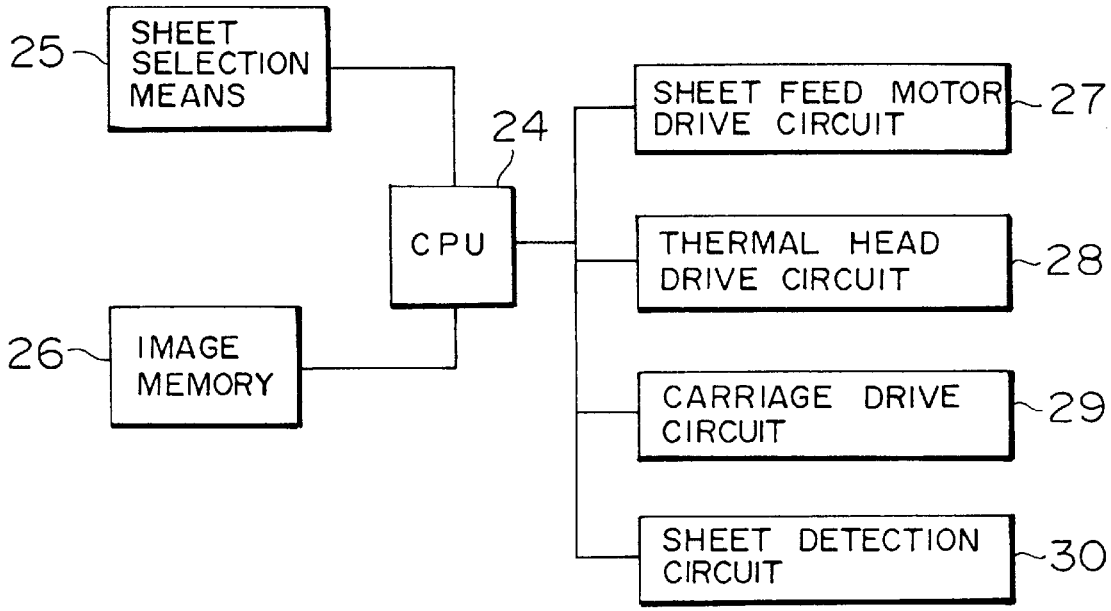
FIG. 1 is a block diagram of an embodiment of a printer to which a sheet feed device of the present invention is applied.

A description will now be given of the preferred embodiments of the printer sheet feed device and a sheet feed control method thereof, with reference to the drawings. Corresponding component parts to those of the conventional example are given the same reference numerals, and will not be described in detail below.

Figure 2:
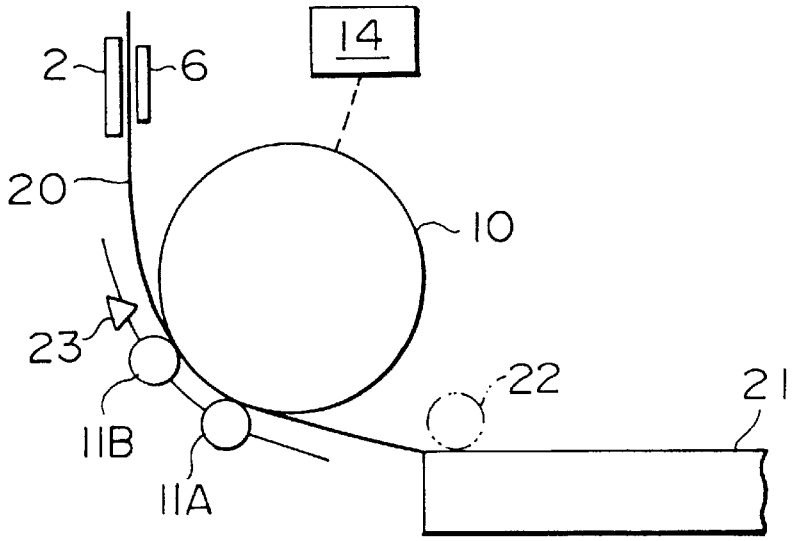
FIG. 2 is a view showing the construction of the critical portion of the sheet feed mechanism of the printer of FIG. 1.

FIG. 1 is a block diagram showing the construction of the critical portion of a printer to which an embodiment of the sheet feed device in accordance with the present invention is applied. FIG. 2 is a view showing the construction of the critical portion of the sheet feed mechanism thereof. Although, as shown in FIG. 2, the illustrated printer of the present embodiment partly differs from the conventional printer in that recording paper sheets 20 are supplied from a sheet feed cassette 21 and separated one sheet at a time by a sheet feed roller 22 and conveyed between a platen 2 and a thermal head 6 by means of a sheet feed roller 10 and a press-contacting roller assembly 11, it is obvious that the printer may have the same construction as the aforementioned conventional printer. The press-contacting roller assembly 11 comprises two press-contacting rollers 11A and 11B which press contact two different locations of the sheet feed roller 10 in the direction of conveyance of the recording sheet, so that the recording sheet 20 is conveyed at a plurality of locations in the direction of conveyance of the recording sheet.

A sheet detector 23, being a photo-sensor which opposes the sheet feed roller 10, is disposed at a location downstream from the press-contacting roller assembly 11 in the direction of conveyance of the recording sheet 20, in order to detect whether or not a sheet is present and the front or back edge of the recording sheet 20. The sheet feed motor, the transmission mechanism, etc., are essentially the same as the conventional ones, so that they will not be described below.

In FIG. 1, a sheet selection means 25 is connected to a central processing unit (CPU) 24, being a control means which performs various control operations in the printer. When the sheet selection means 25 is used to set the type of recording sheet for printing, a signal of the set sheet type is input to the CPU 24. An image memory 26 is connected to the CPU 24, allowing input and output of printing information therebetween.

A sheet feed motor drive circuit 27 is connected to the CPU 24 in order to drive a sheet feed motor (not shown) which is a stepping motor for rotationally driving the sheet feed roller 10. A control signal from the CPU 24 causes the sheet feed motor drive circuit 27 to control the driving of the sheet feed motor. In addition, the CPU 24 is connected to a thermal head drive circuit 28 for supplying power to thermal elements (not shown) of the thermal head 6 on the basis of printing information, a carriage drive circuit 29 for driving a carriage drive motor (not shown) for causing reciprocating movement of a carriage carrying a thermal head 6, and a sheet detection circuit for inputting a sheet detection signal from the sheet detector 23.

As described above, variations in the sheet feed pitches occur at the moment the back edge of the recording sheet 20 passes between the sheet feed roller 10 and the upstream press-contacting roller 11A in the direction of conveyance of the recording sheet 20, when the recording sheet is conveyed at a predetermined pitch by the rotation of the sheet feed roller 10. The present applicant, however, found out that sheet feeding can be performed at the ordinary line feed pitch when line feeding is terminated after further rotationally driving the sheet feed motor, from the moment the back edge passes between the roller 10 and the roller 11A, by a greater number of steps than the predetermined number of steps in order to further convey the recording sheet between the sheet feed roller 10 and the press-contacting roller 11B. Sheet feeding can be performed at the ordinary line feed pitch because the extra amount of feeding (the amount being equal to the amount of backlash) produced upon passage between the rollers is eliminated by the additional rotation.

Figure 3:
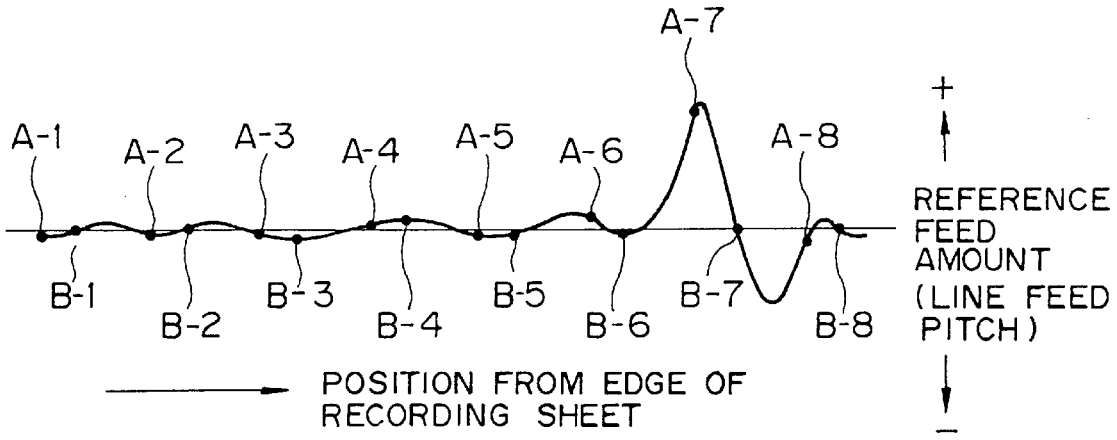
FIG. 3 is a diagram showing deviations from a predetermined pitch, when line feeding is to be performed at a constant pitch in the embodiment of FIG. 1.
Figure 4:
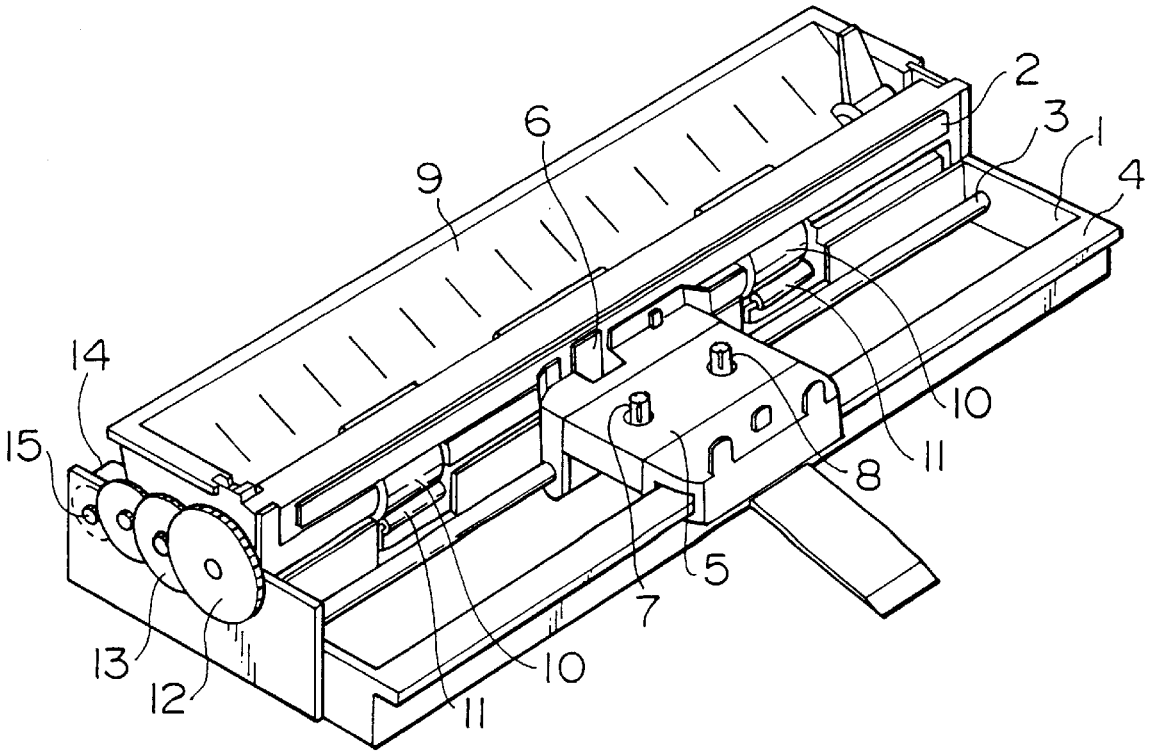
FIG. 4 is a perspective view showing the construction of the critical portion of a conventional serial-type printer.
Figure 5:
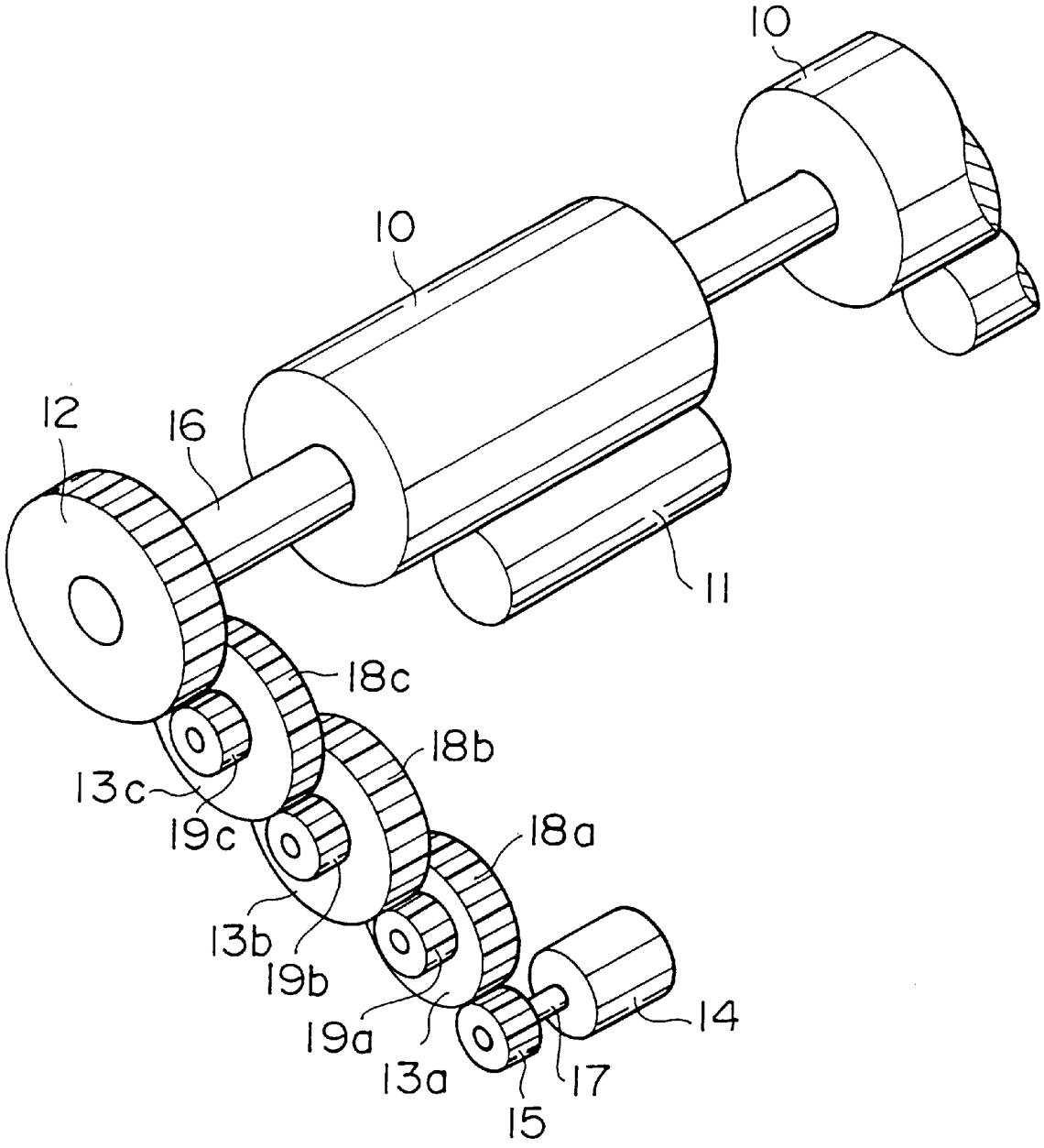
FIG. 5 is a perspective view showing the construction of the critical portion of a sheet feed mechanism of the conventional printer.
Figure 6A:
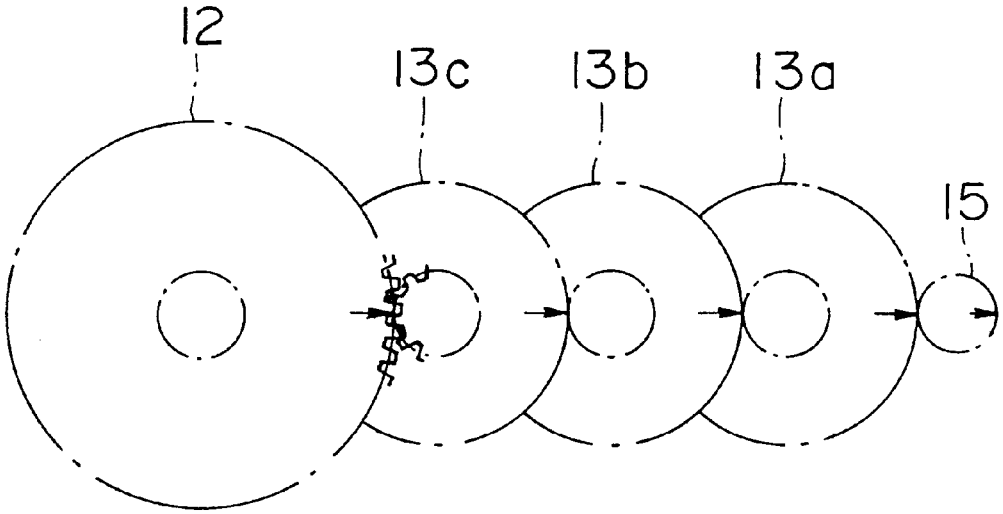
FIGS. 6A and 6B are diagrams for illustrating a drive power transmission system of the sheet feed mechanism of FIG. 4.
Figure 6B:
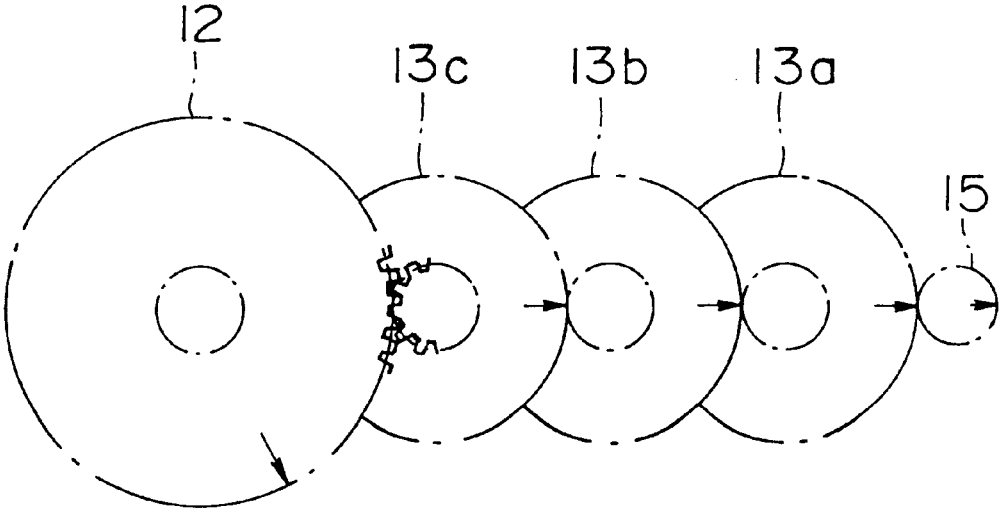

More specifically, when the sheet feed roller 10 is constantly rotated by a certain angle as a result of rotationally driving the sheet feed motor 14 by a predetermined number of driving steps, large variations in the sheet feeding occur at a particular location, as shown in FIG. 3. Referring to FIG. 3, the horizontal axis indicates the positions from an edge of the recording sheet 20, and the horizontal line represents the reference sheet feeding amount, above which the sheet feed amount is positive, and below which the sheet feed amount is negative. The recording sheet 20 is conveyed as a result of driving the sheet feed motor 14. The portions where line feeding of the recording sheet 20 is performed are denoted by A and B. When line feeding is performed first at A-1, line feeding of the recording sheet 20 is successively performed at A-2, A-3, etc. On the other hand, when line feeding is first performed at B-1, line feeding of the recording sheet 20 is successively performed at B-2, B-3, etc.

As can be seen from FIG. 3, when line feeding is successively performed from A-1, defined as the line feed start position, at an initial predetermined pitch, the back edge of the recording sheet 20, as described above, jumps, causing the sheet feed amount to deviate by a large amount in the positive direction at A-7, while the sheet feed amount at A-8 deviates by a large amount in the negative direction. On the other hand, when line feeding is performed from B-1, defined as the line feed start position, the line feed amount is always substantially on the horizontal line, so that the line feed amount at B-7 is not affected by jumping of the back edge of the recording sheet 20.

Accordingly, it is possible to minimize variations in the line feed pitches and control the line feeding to a constant amount by setting the initial line feed start position so that line feeding is not terminated, immediately after passage of the back edge of the recording sheet 20 between the sheet feed roller 10 and the press-contacting roller 11A. Since the recording sheet 20 used is a standard type sheet whose length is set, computation based on the printer characteristics is performed to permit line feeding of the recording sheet 20 under control such that it is performed by a predetermined amount from B-1 of FIG. 3 and successively performed therefrom by a constant amount at all times, which is a distinctive feature of the present invention.

In other words, since the sheet detector 23 and the printing section are separated from each other by a predetermined distance, after the front end of the recording sheet 20 conveyed by the sheet feed roller 10 has been detected by the sheet detector 23, the recording sheet 20 is set to the recording start position by rotationally driving the sheet feed motor 14 by the predetermined number of drive steps set at the CPU 24.

Here, the thermal head 6 has a resolution of 400 dpi, and a one line feed pitch of 9.906 mm, with the number of thermal element dots being 160. For a postcard used as the recording sheet, when the entire length of the postcard in the direction of vertical feeding is 148 mm, and printing can only be performed 3 mm from the top edge of the postcard due to mechanical limitations of the printer, itself, the printing start position is set at 3 mm from the top edge (front face) of the postcard. Here, when the postcard is selected as the recording sheet to be used by the sheet selection means 25, the CPU 24 controls each of the circuits 27 to 30 under the assumption that a postcard is being used as the recording sheet. From the time the sheet detector 23 detects the front edge of the postcard, the sheet feed motor 14 is rotationally driven by a predetermined number of steps in order to set the postcard between the platen 2 and the thermal head 6 such that the printing start position is 3 mm from its front edge. Repeating printing operations and ordinary 9.906-mm line feed operations from the setting causes the line feed operations to be terminated immediately after passage of the back edge of the postcard between the sheet feed roller 10 and the press-contacting roller 11A, so that the line feed pitch at this portion becomes large. This occurs in the present embodiment due to the distance between the thermal head 6 and the press-contact position of the sheet feed roller 10 and the press-contacting roller 11A. To overcome such a problem in the present invention, the reference position is set at 5 mm from the front edge of the postcard, and line feeding at the predetermined line feed pitch of 9.906 mm is performed from the reference position. In other words, printing is performed on a postcard, whose printing start position is set at 3 mm from the front edge, which is set at the printing section, using 34 thermal element dots, starting from those at the upper portion of the thermal head 6. Thereafter, the postcard is fed 2 mm to set the printing start position of the postcard at 5 mm from the top edge. With the printing start position set thus, control operations are performed so that ordinary printing and line feed operations are performed. Here, the line feed pitch is set four thermal element dots less than a printing range of one line in order to prevent the production of gaps between lines due to variations in the amount of line feeding. The problem regarding dark printing portions produced by overlapping between lines is overcome by print data processing.

According to the controlling method described above, a line feeding operation is terminated at a position immediately preceding the position of passage of the back edge of the postcard between the sheet feed roller 10 and the press-contacting roller 11*a,* and the back edge of the postcard passes between the sheet feed roller 10 and the press-contacting roller 11A immediately after the start of a next line feeding operation. Accordingly, after passage of the postcard between the rollers, line feeding is continued by means of the sheet feed roller 10 and the press-contacting roller 11B. Thereafter, the line feeding is terminated after further conveyance of the postcard by a predetermined amount, that is after rotationally driving the sheet feed motor 14 by the predetermined number of driving steps.

When more than 5 millimeters of non-printing space is to be left from the top edge of the postcard, the printing start position is initially set at 5 mm from the top edge and line feeding operations are performed at a constant pitch.

In the present embodiment, the number of drive steps of the sheet feed motor 14 is set to permit line feeding of 9.906 mm. At the moment the back edge of the postcard passes between the sheet feed roller 10 and the press-contacting roller 11A, the number of steps is set to more than two-thirds the number of steps permitting the 9.906-mm line feeding in order to perform line feeding of about 6 mm or more by means of the sheet feed roller 10 and the press-contacting roller 11B, thereby overcoming the problem of variations in the amount of line feed due to postcard jumping.

Although in the present embodiment of the invention, the settings of the printer are as described above, the line feed pitch, the type of recording 20 used, the printable recording sheet range, and the distance from the sheet feed roller and the press-contacting roller to the printing section vary with printers. Therefore, at the moment the back edge of the recording sheet 20 passes between the sheet feed roller 10 and the press-contacting roller 11, the printing start position of the recording sheet 20 to be subjected to ordinary line feeding is set to permit line feeding performed when the number of steps is more than two-thirds that of the set number of steps.

Although the present embodiment has been described for the case where the recording sheet is conveyed by being nipped between the sheet feed roller 10 and the press-contacting roller 11, jumping of the back edge of the recording sheet 20 does not necessarily occur only at the location where the back end of the recording sheet passes between the sheet feed roller 10 and the press-contacting roller 11. For example, jumping of the recording sheet may occur when it is displaced from the sheet guide section, which produces a location where the mechanical conditions of the sheet feed mechanism change. In such a case, it is obvious that the position for starting line feeding by a predetermined amount is set, taking into account such a location.

The present invention is not limited to the above-described preferred embodiments, so that various modifications can be made, when necessary. For example, in the present embodiment, two press-contacting rollers 11A and 11B were used as the rollers which press-contact the sheet feed roller 10 in the construction where the recording sheet is conveyed at a plurality of locations in the direction of conveyance of the recording sheet. However, in another construction, a roller at a recording sheet discharge side in the printer may be used to convey the recording sheet in the printer, with the sheet feed roller 10 press-contacted by only one press-contacting roller.

As can be understood from the foregoing description, according to the printer sheet feed control method of the present invention, the starting position of line feeding at an initial constant pitch is at the portion of the recording sheet where the mechanical conditions of the sheet feeding mechanism change with respect to the recording sheet, in accordance with the type of recording sheet used. Accordingly, sheet feeding can be performed at a fine line feeding pitch by simply controlling the line feeding such that it is performed at a constant pitch from the set position.

What is claimed is:

1. A sheet feeding device for feeding sheets having a front edge and a back edge through a printer, comprising:

a) a controller for determining a line feed start position for the feeding of a sheet;

b) a sheet selection unit communicating to said controller a selected sheet type having a sheet length;

c) a sheet sensor communicating with said controller to detecting a front edge of a sheet d) a first roller having a first outer surface, a second roller having a second outer surface, such that said first outer surface is compressed against said second outer surface, wherein a sheet positioned between said first outer surface and said second outer surface, is rotatable conveyed through said printer; and e) a motor for driving a transmission, wherein said transmission is rotatably connected to said first roller;

wherein said controller comprises a central processing unit, a sheet feed motor drive circuit connected to said central processing unit to operate said motor, and a sheet detection circuit connected to said central processing unit for receiving a detecting signal from said sheet sensor, said controller controlling the line feed start position to begin at a predetermined distance ahead of the front edge of the sheet and wherein the controller maintains the feed pitch for the sheet constant.

* * * * *

UNITED STATES PATENT AND TRADEMARK OFFICE

CERTIFICATE OF CORRECTION

PATENT NO. : 6,017,160
DATED : January 25, 2000
INVENTOR(S) : Minoru Sato et al.

It is certified that error appears in the above-identified patent and that said Letters Patent is hereby corrected as shown below:

Title page,
ABSTRACT,
Line 8, delete "a" and substitute -- an -- in its place.

Claim 1,
Line 8, delete "detecting" and substitute -- detect -- in its place.
Line 13, delete "rotatable" and substitute -- rotatably -- in its place.

Signed and Sealed this

Second Day of April, 2002

*Attest:*

*Attesting Officer*

JAMES E. ROGAN
*Director of the United States Patent and Trademark Office*